United States Patent [19]

Jackson

[11] Patent Number: 4,940,195

[45] Date of Patent: Jul. 10, 1990

[54] DECOY AIRCRAFT

[75] Inventor: David H. Jackson, Lower Ashtead, United Kingdom

[73] Assignee: Hoybond Limited, London, United Kingdom

[21] Appl. No.: 293,230

[22] Filed: Jan. 4, 1989

[30] Foreign Application Priority Data

May 5, 1988 [GB] United Kingdom ..... 8810604

[51] Int. Cl.[5] ..... B64C 00/00

[52] U.S. Cl. ..... 244/1 R; 244/49; 40/539; 273/348; 434/372; 446/487

[58] Field of Search ..... 244/1 R, 114 R, 119, 244/120, 49; 273/348, 11; 434/372; 446/487, 488, 230, 109; 40/539; 342/4, 8–10

[56] References Cited

U.S. PATENT DOCUMENTS

| | | | |
|---|---|---|---|
| 1,318,447 | 10/1919 | Hopkins | 446/488 |
| 1,803,789 | 5/1931 | Burgess | 446/230 |
| 2,360,220 | 10/1944 | Goldman | 273/348 |
| 2,361,929 | 11/1944 | De Florez | 434/372 |
| 4,109,985 | 8/1978 | Lieb | 446/487 |
| 4,407,494 | 10/1983 | Hummel | 446/230 |
| 4,625,972 | 12/1986 | Task et al. | 434/11 |
| 4,713,012 | 12/1987 | Poplawski et al. | 40/539 |

OTHER PUBLICATIONS

Tutin, H308, Jul. 7, 1987.

*Primary Examiner*—Galen Barefoot
*Attorney, Agent, or Firm*—Lawrence M. Nawrocki

[57] ABSTRACT

A decoy aircraft construction of compact format during transport and able to form a decoy model of an aircraft on disposition on an airfield has the form of a rectilinear box blank having six primary panels joined at edges so as to form a box on bringing together free edges thereof. The panels have hinged to each of one or more thereof a single secondary panel or a secondary panel complex formed in turn of a plurality of panels hinged together. No secondary panel or secondary panel complex of the construction when folded at its hinges has overall dimensions greater than those of the primary panels. The location and shape of the secondary panel(s) and secondary panel complex(es) are such that on dismantling to a flat format, the primary panels of the box with the secondary panel(s) and secondary panel complex(es) housed therein, the secondary panel(s) and secondary panel complex(es) augment the flat format by unfolding to impart to it a three dimensional shape simulating that of an aircraft construction.

10 Claims, 3 Drawing Sheets

DECOY AIRCRAFT

FIELD OF THE INVENTION

This invention relates to a decoy aircraft for disposition on airfields or other aircraft operating locations.

BACKGROUND OF THE INVENTION

As part of a modern defence strategy it is desirable to minimise the damage to armed forces camps or airfields by ensuring that, in the event of attack by enemy aircraft, much of the attack is absorbed by non-strategic features so that enemy pilots can nevertheless return to their base satisfied that they have inflicted considerable damage on the offensive capacity of an enemy. To this end, for example, runways may be camouflaged so that they cannot be readily distinguished from surrounding ground when a low flying attack aircraft passes over at speed. Camouflage may also be applied to buildings and military equipment. Such camouflage will not however protect such targets from random bombing of an airfield and then the enemy pilots will see the result of successful bombing raids and be able to report a successful attack to their controlling officers.

OBJECT OF THE INVENTION

It is an object of the present invention to provide decoy means at an airfield which will present themselves as targets to enemy aircraft and indicate illusory success when destroyed thereby.

SUMMARY OF THE INVENTION

According to the present invention, there is provided a decoy aircraft construction able to be of compact format during transport and to form a decoy model of an aircraft on disposition on an airfield, the construction comprising:

six primary panels joined at edges thereof to constitute a rectilinear box blank, and a plurality of secondary structures selected from secondary panels and secondary panel complexes formed in turn of a plurality of panels hinged together, the secondary structures being hinged to respective primary panels with up to all six of the primary panels having a said secondary structure hinged thereto, the or each secondary structure, when folded against its associated primary panel, having overall dimensions smaller than those of the said primary panel for said secondary structure to be housed in a box formed from said box blank;

secondary panel shape and location on the primary panels and, when unfolded, secondary panel complex shape and location on the primary panels being such that on converting said box blank with secondary structures attached to respective primary panels to an opened-out format of primary panels, the secondary structures augment the primary panel format on rotating with respect to the primary panels to impart to the opened-out format a three dimensional shape simulating the shape of an aircraft construction.

This invention provides a decoy construction which may be of light weight and which is capable of ready transport, particularly if the box shaped precursors of the decoy planes are of modular shape in relation to the cross-section of the hold of a transport aircraft which is to deliver them to the site at which they are to be disposed. Whereas previous decoy aircraft have only possessed a crude resemblance to an aeroplane, by suitable shaping of the various secondary panels and panels of secondary panel complexes, it is possible to achieve a relatively sophisticated degree of detail such that an instantaneous glance thereat by a pilot of a low flying plane travelling at considerable speed will leave him feeling confident that real planes are lined up on his bombing run. In the very short time available, pilots are likely to release their bomb load notwithstanding any information being provided by for example infra-red sensors which might suggest that the aeroplanes are not formed of the usual material for aircraft construction.

To allow easy handling of the decoy plane, it is preferably of light-weight construction. A sandwich structure of aluminium foil or thin plate on a foam plastics interior will generally suffice and enables predetermined fold positions to be readily provided between the primary panels, for example introducing a gap or a cut into the foam "filling" before completion of the sandwich structure. Such a material is also readily capable of painting with a camouflage material to simulate further the appearance of a plane. Alternatively, the panels may be formed as frame structures over each of which canvas is stretched or to each of which other covering material such as sheet aluminium is applied.

One or more primary panels may be formed externally of the box with mountings to which are attached wheel constructions so as to allow the box constructions, whether or not they are yet opened up to form decoy planes to be pushed manually or towed by powered vehicle to the desired siting. If such wheel constructions can be positioned flat against the surface of the box when the latter is in the folded conformation, the modular character thereof for transport will not be significantly affected. Likewise the modular character of the construction will not be affected significantly if one or more panels carry inflatable tubular arrangements such as water-impermeable sacks or inflatable plastics tubing which may be filled with water when the decoy plane is disposed on an airfield and closed. The filling with water will serve to weight down the decoy plane and ensure its stable positioning on an airfield.

DETAILED DESCRIPTION OF THE INVENTION

Figure 1:
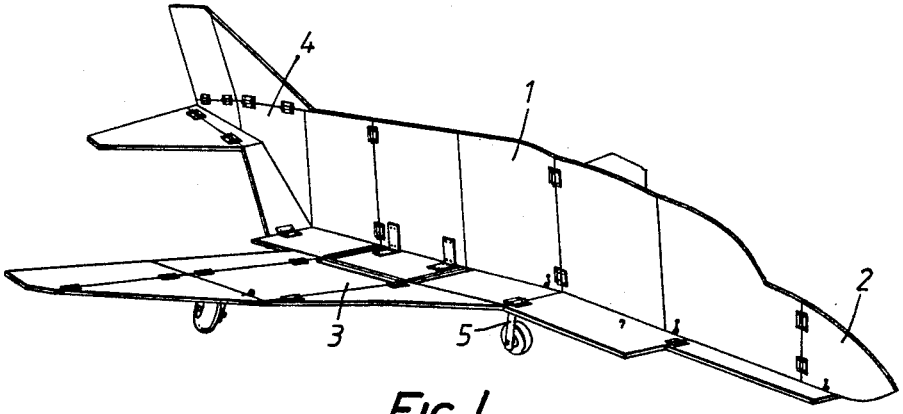
FIG. 1 shows an assembled decoy plane according to the invention in perspective view.

Referring to the drawings, FIG. 1 shows a decoy plane simulating a F4 Phantom Jet in service with many air forces around the world. The decoy as shown is about 1:8 scale of actual aeroplane size and has been produced in a box structure of cubic form of edge approximately 45 cm. The decoy comprises a fuselage 1, nose part 2, wings 3, tail assembly 4 and undercarriage 5.

Figure 2:
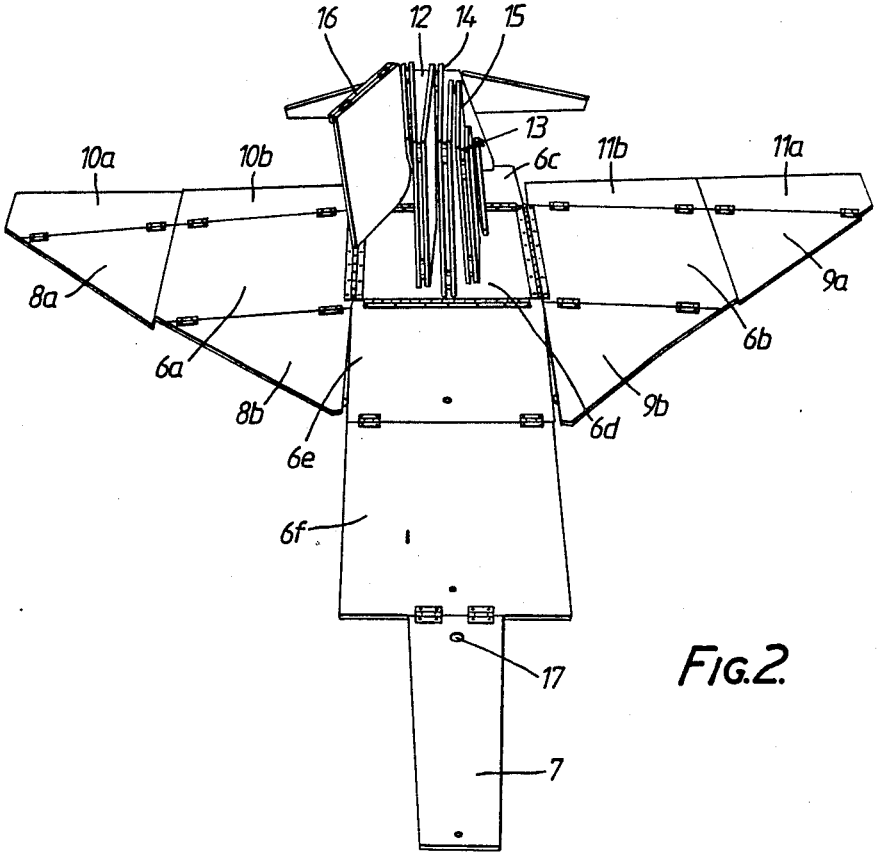
FIG. 2 shows the blank from which the decoy plane has been produced, but with the fuselage vertical section and tail portion being shown only in a folded state.

Turning to FIG. 2, this shows the basic box structure from which the decoy plane is made, the box structure comprising six panels 6a to 6f which because of their square format are assemblable to form a cube. Panels 6c to 6f form the base of the fuselage and to the forward end of panel 6f is hingedly attached a panel 7 which is to form the base of the nose part 2. Attached to panels 6a and 6b, which may be termed the root panels of the triangular wings, are two triangular panels 8a and 8b and 9a and 9b respectively. Rear flap panels 10a and 10b are attached respectively to panels 8a and 6a and rear flap panels 11a and 11b are attached respectively to panels 9a and 6b. Hingedly attached to panel 6c in a rear portion thereof is a complex panel unit 12 whose individual components are hinged together and which can be unfolded to form the tail unit 4 of the aircraft. Hingedly attached to panel 6d is a further complex panel unit 13. This is hingedly attached in a central region of the panel so as to lie within a central region of the assembled box from which the decoy aircraft is to be made. The complex panel 13 comprises a root panel 14 which is attached to panel 6d and forwardly and rearwardly extendable panel complexes 15 and 16 which respectively are to form the forward part of the fuselage 1 and the nose part 2 on the one hand and the rear part of the fuselage 1 on the other hand. Dowels (not clearly visible) attached to the under edges of the component panels of the panel complexes 15 and 16 engage with holes 17 formed in the base of the fuselage to allow the fuselage simulating panels to stand vertically with respect to the fuselage base. An appropriate arrangement of dowels in the rear part 16 of the panel complex 13 engages holes in the component panels of the tail part to allow the latter to be raised to the correct elevation. Appropriate connections, such as hooks and rings, are employed wherever edges of panels are brought together when placing the blank in the format of a decoy plane, thereby to ensure the dimensional integrity of the decoy.

Figure 3:
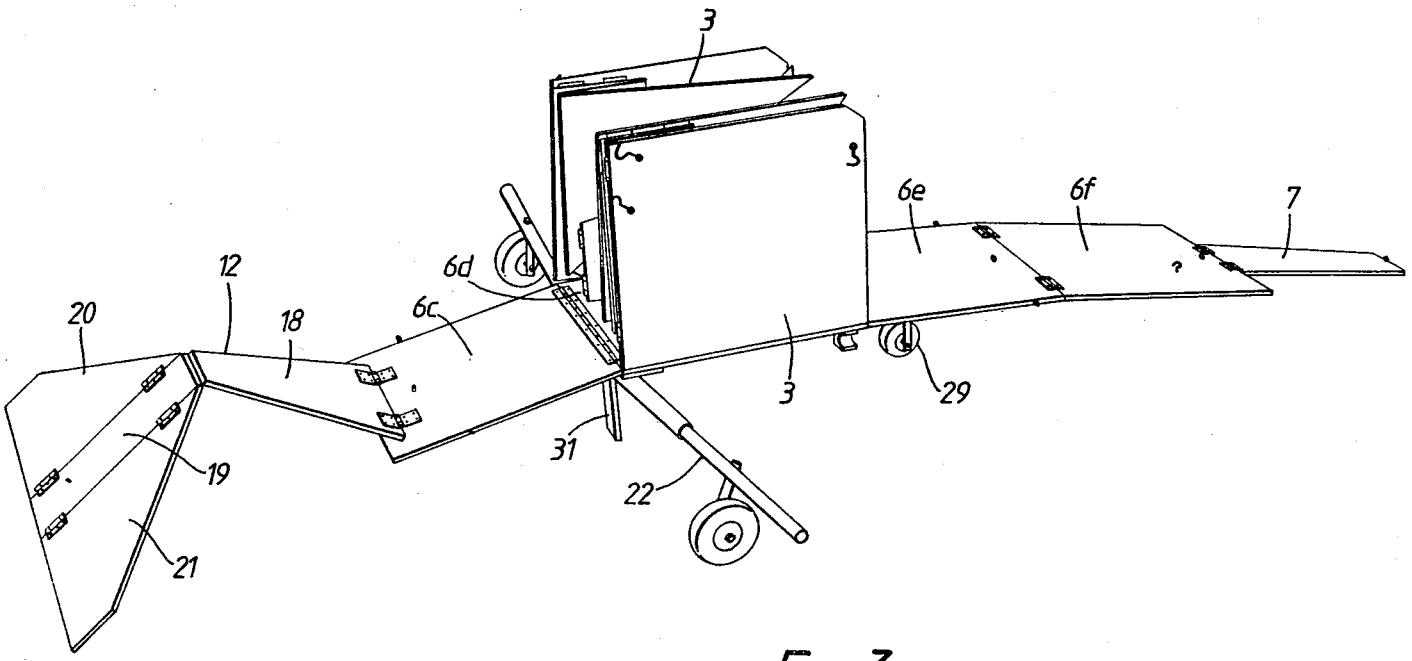
FIG. 3 shows the decoy plane with wings folded up.

FIG. 3 assists in understanding how the blank is assembled. The central portion of the plane can be seen to be formed from the line of panels 6c to 6f. The complex panel 12 is seen to be hingedly attached to panel 6c at a position forward of the rear edge thereof and comprises hinged central panels 18 and 19 and wing panels 20 and 21 attached to the latter. The wings 3 and the fuselage components are folded up so as to lie at right angles to panel 6d and are in the configuration which they will possess with respect to panel 6d when enclosed in the assembled box. Extending from the underside of panel 6d is a wheeled undercarriage 22. A nose wheel 22 is mounted below panel 6e, that is somewhat to the rear of the part of the plane designated as the nose.

Figure 4:
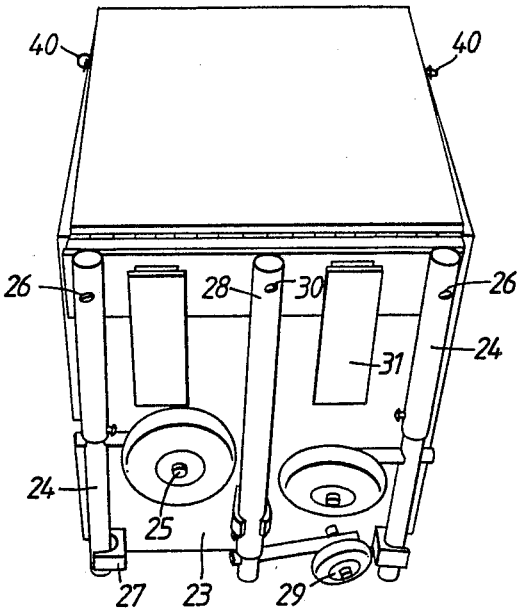
FIG. 4 is an underside view of the box structure from which the decoy is produced, in a form suitable for transportation.

The disposition of the undercarriage can be best understood by reference to FIG. 4 which shows the assembled box with all the secondary panels and secondary panel complex panels out of view within the box and the adjoining free edges of the box forming panels held together by hook and ring arrangement 40. The underside of the box shown at 23 has mounted thereon at opposite edge regions two telescopic arms 24 each carrying a wheel 25. The arms are attached by a pivoting pin 26 at the rearward edge region of underside 23 and, to retain them in place during transport, engage at their outer ends in clips 27. Positioned between the arms 24 to lie along the mid line of the aircraft is a further telescopic arm 28 which carries the wheel 29 at its forward end, which wheel is smaller than the wheels 25 and is intended to simulate the nose wheel of the aircraft. The arm 28 is pivotably mounted on a pin 30 so that it can be rotated in the plane of the base 23 through 180° to the orientation shown in FIG. 3. Between them, the wheels 25 and 29 enable the assembled decoy to be moved about. Support struts 31 hingedly attached to the base 23 enable further support to be given to the decoy and prevent the decoy from rolling out of position.

Figure 5:
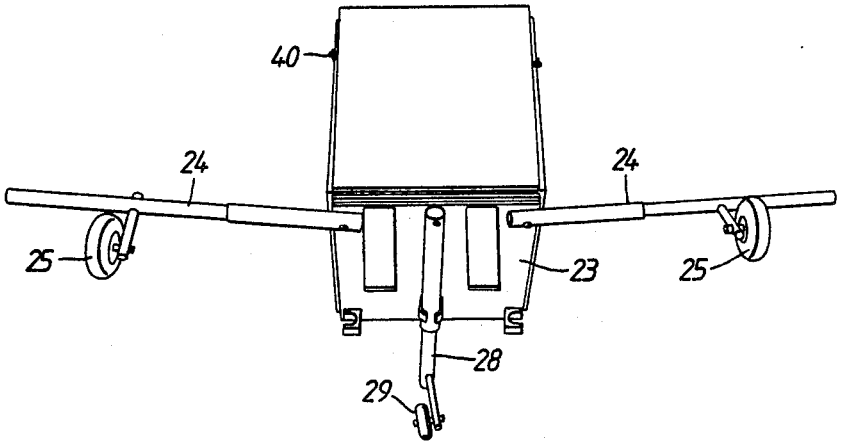
FIG. 5 shows wheel structures simulating an undercarriage unfolded from the underside of the box structure.

Finally, FIG. 5 shows the underside 23 with the arms 24 and 28 fully extended and the supports 31 lowered thereby indicating more clearly how the decoy plane will be supported on a runway. Not shown in any of the Figures are the water-carrying sacks attached to the underside of the wings for weighting down the decoy.

The decoy aircraft shown in the accompanying views is simply and inexpensively manufactured from readily available light-weight materials which allow the provision of fold lines where the box panels adjoin and the hinged attachment thereto of the various panels. It has been found acceptable to employ a sandwich structure having a foam plastics inner lamina for this purpose. The inner lamina, in one embodiment, is clad on each of opposite sides with a realistic aircraft skin simulation material. It is envisioned that aluminum foil or a thin plate metal material would be used. As shown, the decoy is formed from a cubic structure which when fully opened out conveniently provides a decoy sized from about 80 to 100% the size of the plane which is being simulated. A size of decoy slightly less than the actual size is generally permissible since an attacking pilot in the short time available to him will not generally be able to distinguish between full size and such reduced size aeroplane dimensions.

As stated above, the illustrated decoy plane simulates an F4 phantom fighter. Using the same principle it has been found possible to produce decoys simulating the following aircraft:

1. The F-16 USAF fighting Falcon manufactured by General Dynamics
2. The F-15 USAF Eagle manufactured by MacDonald Douglas
3. The Tornado—all versions
4. The F-1 Mirage—all versions
5. The Harrier (GRMk3, TMk 2A, AV-8A, B, TAV-8A, B AV-8S, TAV 8-S, T, Mk4, FRS Mk1, FRS Mk51).
6. F111 Fighter For training purposes it is also conceivable that aircraft of an adversary or competitor state be simulated and deployed for ground recognition exercises by pilots in training.

Merely by increasing or decreasing the number of panels in a complex secondary panel, it is possible to achieve the many variations which are required. Any shaping of panels will be determined by the shape of the plane which it is desired to simulate. Folding of the various non-primary panels and their positioning will generally enable the wide variety of aircraft shapes indicated above to be attained without departing from the constructional principle of the invention.

Numerous characteristics and advantages of the invention of this document have been set forth in the foregoing description. It will be understood however, that this disclosure is, in many respects, only illustrative. Changes may be made in details, particularly in matters of size, shape and arrangement of parts without exceeding the scope of the invention. The invention scope is defined in the language in which the appended claims are expressed.

I claim:

1. A decoy aircraft construction able to be of compact format during transport and to form a decoy model of an aircraft on disposition on an airfield, comprising:

six primary panels joined at edges thereof to comprise an enclosure box blank, and a plurality of secondary structures selected from secondary panels and secondary panels complexes formed of a plurality of panels hinged together, the secondary structures being hinged to respective primary panels to form a unitary structure, with up to all six of the primary panels having a said secondary structure hinged thereto, each secondary structure, when folded against its associated primary panel, having overall dimensions smaller than those of the said primary panel, wherein each of said secondary structures is able to be housed in a box formed from said box blank;

secondary panel shape and location on the primary panels and, when unfolded, secondary panel complex shape and location on the primary panels being such that, on converting said box blank with secondary structures attached to respective primary panels to an opened-out format of primary panels, the secondary structures augment the primary pane format to impart to the opened-out format a three dimensional shape simulating the shape of an aircraft construction.

2. A decoy aircraft construction as claimed in claim 1 wherein said panels have a sandwich structure of a foam plastics interior clad on each side with a material selected from aluminium foil and thin plate metal.

3. A decoy aircraft as claimed in claim 2, wherein said hinges are formed by fold positions at predetermined said sandwich structure.

4. A decoy aircraft as claimed in claim 1, wherein said panels are formed as frame structures whose frame members are spanned by frame covering material.

5. A decoy aircraft construction as claimed in claim 1, wherein one or more primary panels is provided externally of the box with mounting means mounting wheel constructions supporting the decoy aircraft construction when the box is in its unfolded condition.

6. A decoy aircraft construction as claimed in claim 5, wherein said wheel constructions position flatly against the surface of said box when formed from said box blank.

7. A decoy aircraft construction as claimed in claim 5, said wheel constructions include a wheeled undercarriage comprising telescopically extending arms pivotally attached to respective panels.

8. A decoy aircraft as claimed in claim 1, wherein said box is of cubic form with edges approximately 45 cm long.

9. A decoy aircraft construction as claimed in claim 8, sized to be from 80% to 100% of actual aeroplane size.

10. A decoy aircraft construction as claimed in claim 1, additionally comprising engagement means on adjacent panels positioned and constructed to allow fuselage simulating panels of the decoy aircraft to stand vertically with respect to fuselage base simulating panels.

* * * * *